United States Patent [19]

Wu

[11] Patent Number: 5,059,939

[45] Date of Patent: Oct. 22, 1991

[54] VARIABLE RESISTOR DEVICE

[76] Inventor: I-Long Wu, 2F, No. 85-1, Ning-Han St., Taichung City, Taiwan

[21] Appl. No.: 580,596

[22] Filed: Sep. 11, 1990

[51] Int. Cl.[5] ..... H01C 10/06

[52] U.S. Cl. ..... 338/93; 338/96; 338/139; 338/141; 84/423 B; 340/711

[58] Field of Search ..... 338/93, 96, 139, 141; 340/711, 712, 815.13; 84/423 B

[56] References Cited

U.S. PATENT DOCUMENTS

| | | | |
|---|---|---|---|
| 260,623 | 7/1882 | Starr | 338/96 |
| 488,121 | 12/1892 | Houghton et al. | 338/96 X |
| 3,134,045 | 5/1964 | Shulman et al. | 338/93 X |
| 4,257,305 | 3/1981 | Friend et al. | 338/96 X |

*Primary Examiner*—Marvin M. Lateef
*Attorney, Agent, or Firm*—Cushman, Darby & Cushman

[57] ABSTRACT

A push button variable resistor device includes a hollow push button seat member confining a receiving space, and at least one resistor piece fixed inside the seat member. The resistor piece has a contact portion and at least one leg portion projecting outward through a base portion of the seat member. A spiral spring resistor is disposed inside the receiving space of the seat member above the resistor piece. The spring resistor has a plurality of concentric turns of varying diameters. A push button is slidably fitted through a button opening of the seat member. The spring resistor hs a topmost turn cooperatively associated with the push button. The push button is externally pushed to compress the spring resistor to cause the concentric turns to contact the resistor piece. The contact area between the spring resistor and the resistor piece varies according to the degree of depression of the push button to correspondingly vary the output resistance of the variable resistor device.

10 Claims, 8 Drawing Sheets

VARIABLE RESISTOR DEVICE

BACKGROUND OF THE INVENTION

The invention relates to a variable resistor device, more particularly to a device wherein resistance is varied by pressing a push button.

Variable resistor devices are known in the art. Examples of such devices include slide-wire potentiometers and dial resistors.

The objective of the present invention is to provide a novel variable resistor device wherein the resistance is varied by pressing a push button.

Another objective of the present invention is to provide a push button variable resistor device which can be incorporated in a key of a computer keyboard or an electronic organ keyboard.

SUMMARY OF THE INVENTION

Accordingly, the preferred embodiment of a push button variable resistor device according to the present invention includes a hollow push button seat member confining a receiving space, and at least one resistor piece fixed inside the seat member. The resistor piece has a contact portion and two leg portions projecting outward through the base of the seat member. A spiral spring resistor is disposed inside the receiving space of the seat member above the resistor piece. The spring resistor has a plurality of concentric turns of varying diameters. A push button is slidably fitted through a button opening of the seat member. The spring resistor has a topmost turn cooperatively associated with the push button. The push button compresses the spring resistor, forcing its concentric turns to contact the resistor piece one after the other. The contact area between the spring resistor and the resistor piece varies according to the degree of depression of the push button. This makes possible the objective of varying the resistance with the use of a push button.

The present invention can be applied in a keyboard which includes a plate member having a plurality of openings, a base plate fastened to the plate member, a circuit board fixed between the plate member and the base plate, and a plurality of cavity members provided between the plate member and the base plate and accessible through the openings. A spiral spring resistor with a plurality of concentric turns of decreasing diameter is disposed inside each of the cavity members. A predetermined number of resistor pieces is disposed on the circuit board below each spring resistor. Each resistor piece has a pair of leg portions attached to the circuit board. The keyboard further includes a plurality of push buttons cooperatively associated with the spring resistors.

Whenever one of the push buttons is pressed, the spiral spring resistor beneath it is urged by the push button towards the resistor pieces to initiate contact between the spiral spring resistor and the resistor pieces. This results in a decrease in resistance, which signifies that a key has been depressed.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENTS

Figure 1:
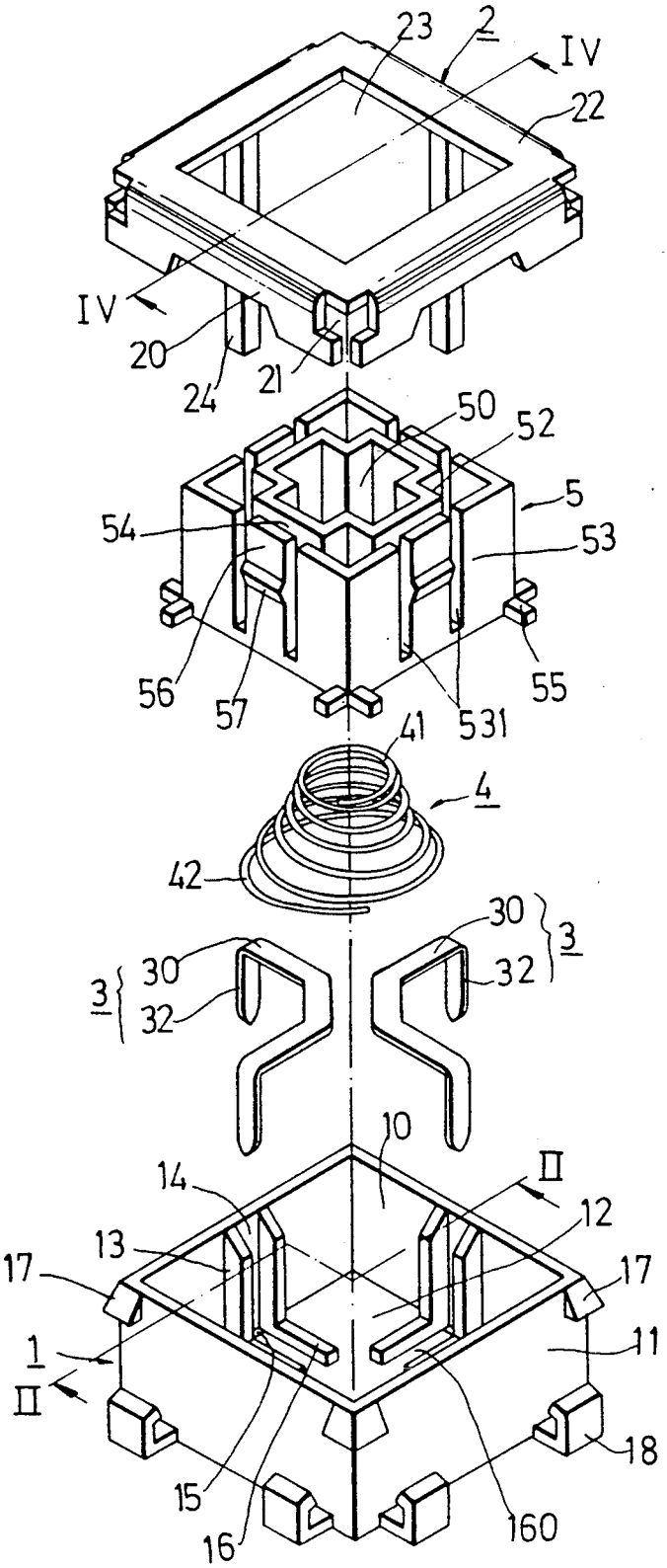
FIG. 1 is an exploded view of the preferred embodiment of a variable resistor device according to the present invention.

Referring to FIG. 1, the preferred embodiment of a variable resistor device according to the present invention is shown to comprise a seat casing 1, a seat cover 2, a predetermined number of resistor pieces 3, a spiral spring resistor 4, and a push button 5.

Figure 2:
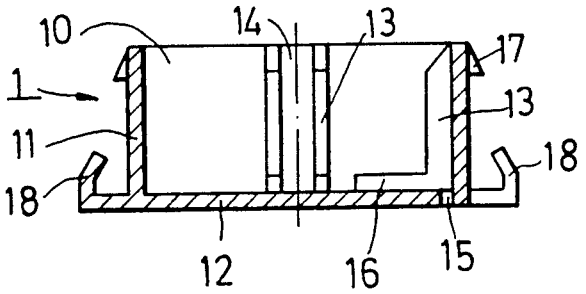
FIG. 2 is a sectional view of a seat of the variable resistor device according to the present invention.

The seat casing 1 has four square walls 11 and a square base 12 that confine a receiving space 10. Referring to FIGS. 1 and 2, each of the square walls 11 has a pair of inwardly projecting parallel retaining ribs 13. Each of the retaining ribs 13 are disposed equally distant from the center of each square wall 11 and extend from the top end of the square wall 11 to the square base 12. Each pair of vertical ribs 13 defines a groove 14. The square base 12 has an opening 15 directly beneath each groove 14. A pair of transverse raised ribs 16 extend from each pair of vertical ribs 13 at the square base 12. Each pair of transverse raised ribs 16 define a second groove 160.

Figure 3:
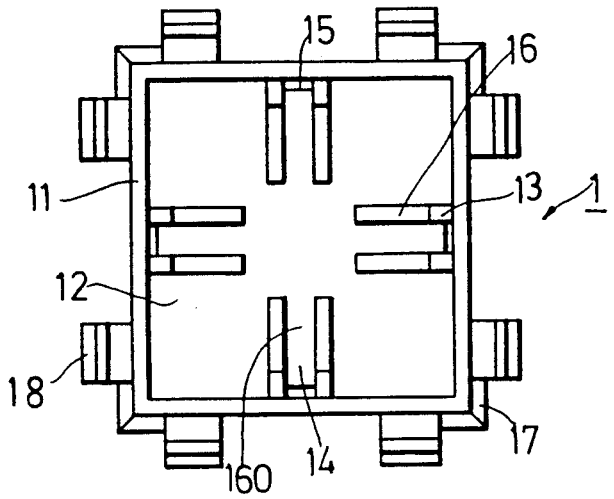
FIG. 3 is a top view of the seat of the preferred embodiment.

Referring to FIG. 3, an outwardly protruding hook 17 projects from each of the two upper corners at the outer face of each square wall 11. A pair of spaced rail receiving hooks 18 projects from the lower edge of each square wall 11.

Figure 4:
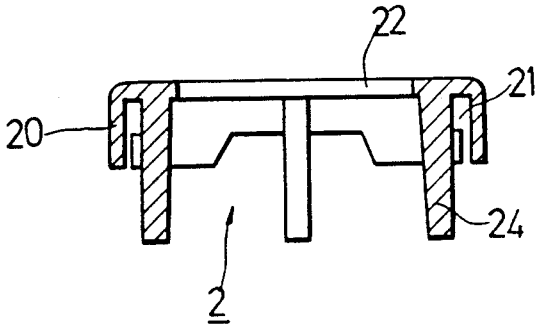
FIG. 4 is a sectional view of a cover of the preferred embodiment.

Referring once more to FIG. 1, the seat cover 2 has a square top wall 22 with a central square button opening 23. Four flanges 20 extend downward from the four outer edges of the top wall 22. Four engaging notches 21 are formed in the flanges 20 adjacent to four corners of the top will 22. Referring to FIGS. 1 and 4, the seat cover 2 further includes four support posts 24 which extend downward from the top wall 22.

Referring again to FIG. 1, each of the resistor pieces 3 can be made from materials of different resistivity. The first preferred embodiment has two resistor pieces 3. Each resistor piece 3 is formed as a strip with a contact portion 30 and a pair of downwardly extending leg portions 32. The resistor pieces 3 and the spiral spring resistor 4 preferably conform to one of the following combinations:

(a) The resistor pieces 3 are made of a material of high resistivity. The spiral spring resistor 4 is made of a material of low resistivity.

(b) The resistor pieces 3 are made of a material of low resistivity. The spiral spring resistor 4 is made of a material of high resistivity.

(c) Both the resistor pieces 3 and the spiral spring resistor 4 are made of materials having high resistivity.

The spiral spring resistor 4 comprises a series of concentric turns of increasing diameter: the topmost turn 41 of the spiral spring resistor 4 has the smallest diameter while the bottom endmost turn 42 of the spiral spring resistor 4 has the widest diameter. Applying a compressing force on the topmost turn 41 of the spiral spring resistor 4 causes the other turns of the spiral spring resistor 4 to contact the resistor pieces 3. The number of turns of the spiral spring resistor 4 which contact the resistor pieces 3 depends upon the magnitude of the pressing force applied.

Figure 5:
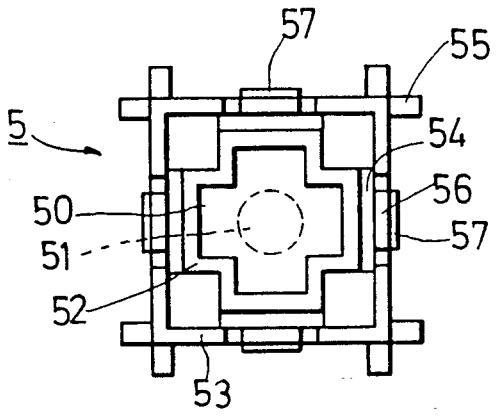
FIG. 5 is a top view of a push button of the preferred embodiment.
Figure 6:
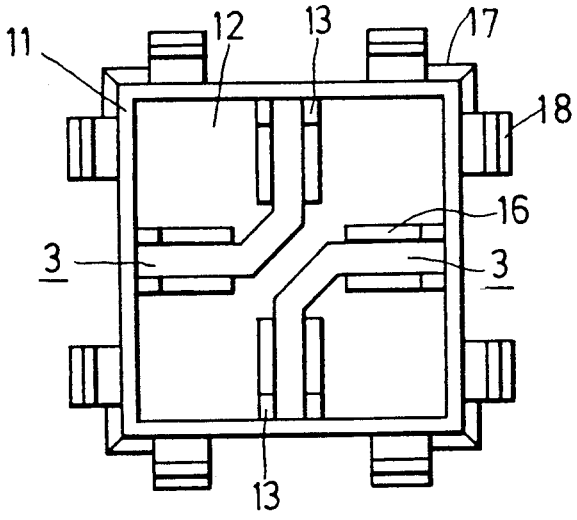
FIG. 6 is a top view of a partially assembled variable resistor device according to the present invention.

Referring to FIGS. 1 and 5, the push button 5 has four square walls 53 which form a square box that is to be fitted into the button opening 23 of the seat cover 2. The topmost turn 41 of the spiral spring resistor 4 surrounds a downward projection 51 that protrudes from a bottom wall of the push button 5. The push button 5 has inner wall portions 52 which confine a cross-shaped receiving space 50. The inner wall portions 52 and the square walls 53 of the push button 5 confine a clearance 54. A pair of transverse outward projections 55 extends from the two lower corners of each square wall 53. The outward projections 55 slidably contact the square walls 11 of the seat casing 1. Each square wall 53 has a pair of spaced vertical grooves 531 to form a resilient piece 56. Each resilient piece 56 has a horizontal outward projection 57 that is substantially triangular in shape. When a pressing force is applied to the horizontal projection 57, the resilient piece 56 is forced to lean into the clearance 54. Movement of the push button 5 relative to the seat cover 2 would cause the peripheral edges confining the button opening 23 to contact the horizontal projection 57 and thus cause the application of a pressing force thereat.

Assembly of the preferred embodiment is as follows:

(a) Referring to FIGS. 1 through 6, each leg portion 32 of the resistor pieces 3 extends through the square base 12 of the seat casing 1 through one of the openings 15. Each resistor piece 3 has two segments that are received in two of the grooves 160 defined by the transverse raised ribs 16. This prevents movement of the resistor pieces 3. The contact portions 30 of the resistor pieces 3 are spaced from each other and are disposed at a central area of the base portion 12.

(b) After the resistor pieces 3 have been placed in the seat casing 1, the spiral spring resistor 4 is placed inside the receiving space 10 of the seat casing 1. The transverse raised ribs 16 support the bottom endmost turn 42 to space the spiral spring resistor 4 from the resistor pieces 3, thus providing electrical isolation. The bottom endmost turn 42 may be coated with an insulating material to prevent electrical contact between the bottom endmost turn 42 and the resistor pieces 3. An open circuit condition is thus defined when the preferred embodiment is not in use.

(c) After the spiral spring resistor 4 has been placed inside the receiving space 10, the push button 5 is placed on top of the spiral spring resistor 4. The outward projections 55 of the push button 5 are in contact with the square walls 11 of the seat casing 1. The topmost turn 41 of the spiral spring resistor 4 is disposed around the downward projection 51 of the push button 5. This prevents lateral skewing of the spring resistor 4 when compressed.

Figure 7:
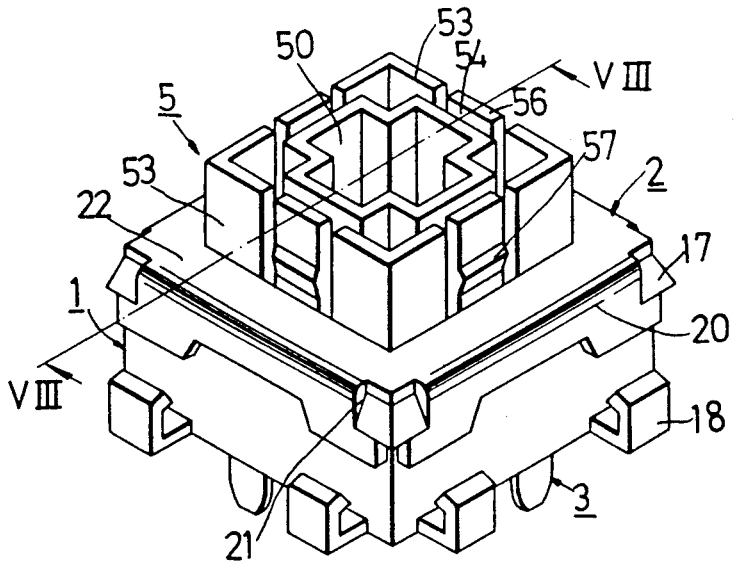
FIGS. 7 and 7A are perspective views of the preferred embodiment illustrating assembly.

(d) Finally, referring to FIGS. 1 and 7, the seat cover 2 is engaged with the top end of the seat casing 1. The push button 5 projects through the button opening 23 of the seat cover 2. Each support post 24 of the seat cover 2 extends into one of the grooves 14 defined by the vertical ribs 13 of the seat casing 1. The extreme end of each support post 24 presses one of the resistor pieces 3 against the seat casing 1, to prevent vertical displacement of the resistor pieces 3. The seat cover 2 is tightly pressed toward the seat casing 1 to permit the engagement of the hooks 17 of the seat casing 1 with the engaging notches 21 of the seat cover 2, thus fixing the seat cover 2 to the seat casing 1.

Figure 7A:
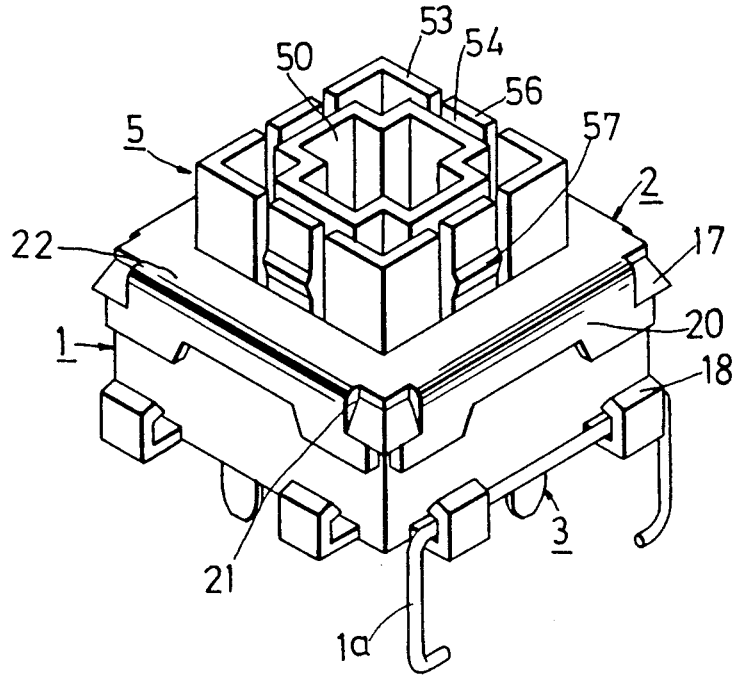

Referring to FIG. 7A, a bent support rail 1*a* is longitudinally disposed between each pair of receiving hooks 18. The support rail la provides stability to the variable resistor device when a pressing force is applied on the push button 5.

Figure 8B:
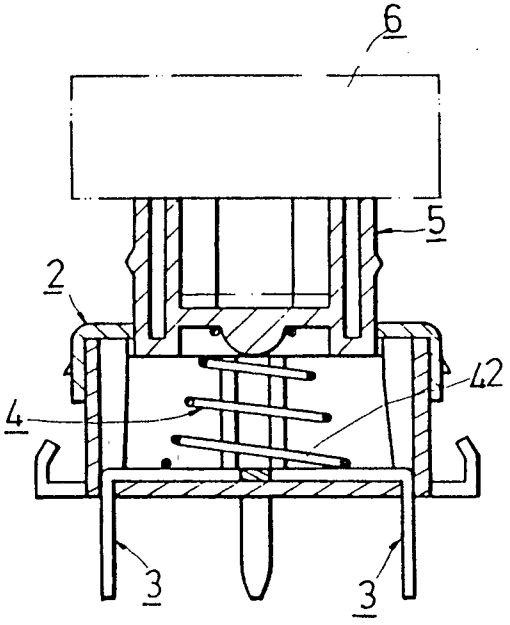
FIG. 8B illustrates an alternative arrangement of the spring resistor and the resistor pieces of the variable resistor device according to the present invention.
Figure 8A:
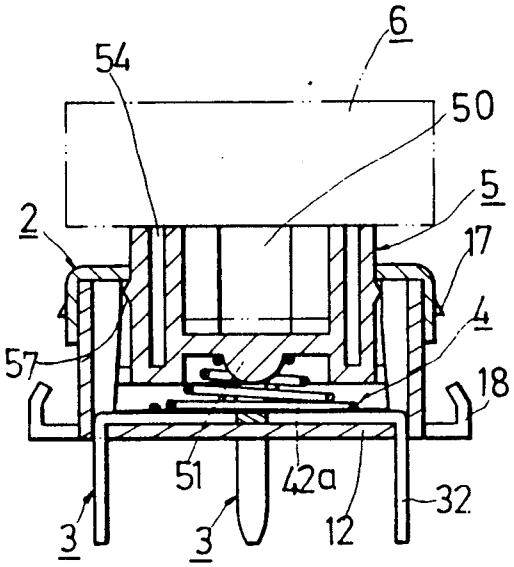
FIGS. 8 and 8A are sectional views of the assembled preferred embodiment illustrating its operation.
Figure 8:
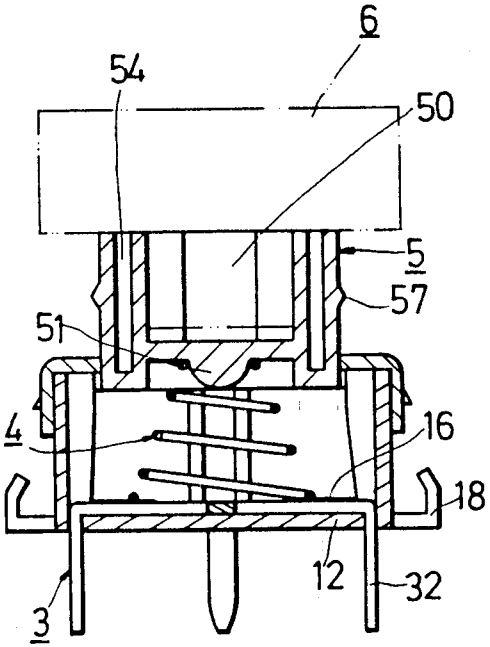

FIGS. 8 and 8A illustrate the operation of the preferred embodiment. The leg portions 32 of the resistor pieces 3 are to be electrically connected to the control circuit of a computer keyboard (not shown). A key cap 6 of a conventional computer key is connected to the push button 5 at the cross-shaped receiving space 50. Referring to FIG. 8A, when a slight pressing force is applied on the key cap 6, the spiral spring resistor 4 starts to compress and its second bottom endmost turn 42*a* contacts the resistor pieces 3. Current starts to flow through the resistor pieces 3 to signify a closed circuit condition. When the magnitude of the pressing force applied is increased, the succeeding turns consecutively contact the resistor pieces 3. As the number of turns of the spiral spring resistor 4 which come into contact with the resistor pieces 3 increases, the contact area between the resistor pieces 3 and the spiral spring resistor 4 similarly increases, thereby decreasing the magnitude of the resistance between the two resistor pieces 3. Thus, when the third and fourth bottom endmost turns come into contact with the resistor pieces 3, the current passing through the resistor pieces 3 encounters a different resistance level, thus resulting in varying voltages.

When the key cap 6 continues to move in a downward direction, the seat cover 2 comes into contact with the horizontal projection 57 of the push button 5, thus forcing the resilient piece 56 of the push button 5 into the clearance 54. The peripheral edges of the seat cover 2 which define the button opening 23 prevent the spiral spring resistor 4 from expanding back into its uncompressed state when the horizontal projection 57 is disposed below the top wall 22 of the seat cover 2. The key cap 6 is pulled upward to move the horizontal projection 57 past the top wall 22 to permit the spring 4 to return to its uncompressed state.

FIG. 8B illustrates an alternative arrangement of the spiral spring resistor 4 and the resistor pieces 3. The bottom endmost turn 42 is coated with an insulating material and is in constant contact with the resistor pieces 3.

Figure 9:
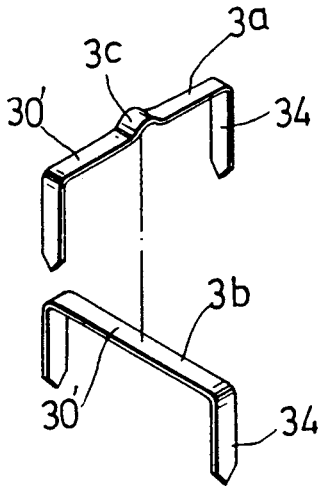
FIG. 9 is a second preferred embodiment of a pair of resistor pieces of the variable resistor device of the present invention.

FIG. 9 is a second preferred embodiment of a pair of resistor pieces according to the present invention. The resistor pieces 3*a* and 3*b* each have a pair of downwardly extending leg portions 34 which extend through the square base 12 through the openings 15. The resistor pieces 3*a* and 3*b* each have a flat contact portion 30' for the spiral spring resistor 4. The resistor piece 3*a* is disposed transverse to and on top of the resistor piece 3*b*. The resistor piece 3*a* has an upwardly projecting bent portion 3*c* to prevent the resistor piece 3*a* from coming into contact with the resistor piece 3*b*.

Figure 10:
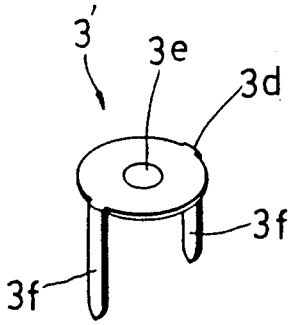
FIG. 10 is a third preferred embodiment of a resistor piece of the present invention.

FIG. 10 is another preferred embodiment of a resistor piece according to the present invention. The resistor piece 3' comprises an annular contact portion 3*d* with a central circular opening 3*e* and a pair of downwardly extending leg portions 3*f*.

Figure 10A:
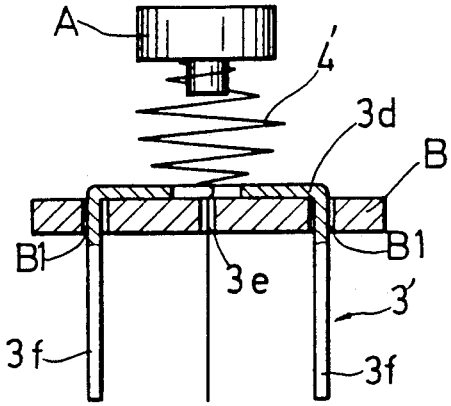
FIGS. 10A and 10B illustrate the operation of the present invention using the resistor piece shown in FIG. 10.
Figure 10B:
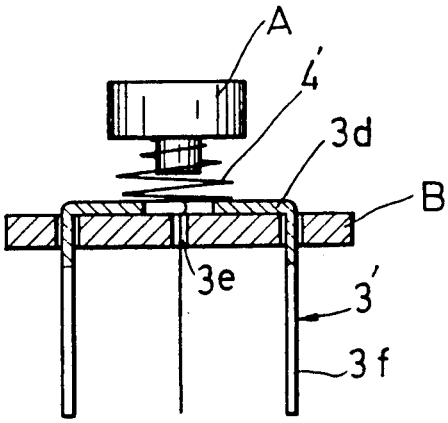

Referring to FIGS. 10A and 10B, the pair of downwardly extending leg portions 3*f* extend through holes B1 of a seat member B. Either of the following spiral spring resistors 4' may be used: (a) a spiral spring resistor 4*a* (not shown) comprising a series of turns of decreasing diameter with the topmost turn having the widest diameter and the bottom endmost turn having the smallest diameter; or (b) a spiral spring resistor 4*b* (shown in FIGS. 10A and 10B) comprising a series of turns with the centermost turn having the widest diameter and the topmost and bottom endmost turns having the smallest diameters.

The topmost turn of the spiral spring resistor 4' is in contact with a push button piece A. The bottom endmost turn of the spiral spring resistor 4' is disposed in the central circular opening 3*e* and extends outward through the seat member B. The spring 4' is not in contact with the resistor piece 3' when it is in an uncompressed state. When the spring 4' starts to compress, it contacts the resistor piece 3' to vary the resistance measured between one of the leg portions 3*f* of the resistor piece 3' and the bottom endmost turn of the spring 4'. As the contact area between the spring 4' and the resistor piece 3' increases, the resistance decreases.

Figure 11:
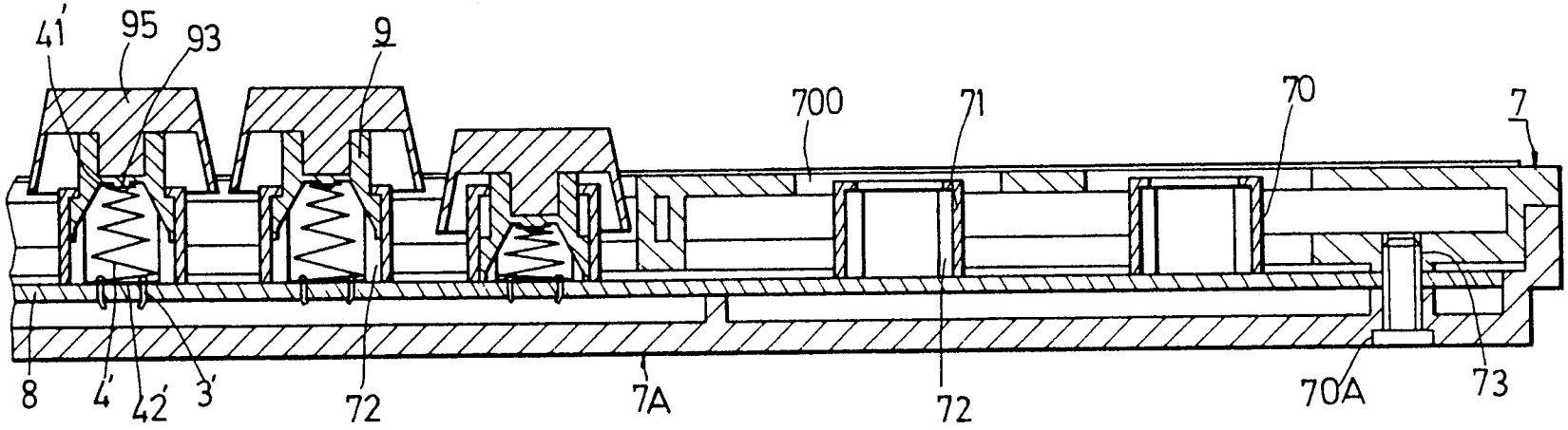
FIG. 11 is a sectional view of a keyboard incorporating the variable resistor device according to the present invention.

FIG. 11 is an illustration of a keyboard incorporating the variable resistor device according to the present invention. A plate member 7, similar to the plate member of a conventional computer keyboard, has a plurality of openings 700. A base plate 7A is fastened to the plate member 7. A plurality of cavity members 70 is provided between the plate member 7 and the base plate 7A. The cavity members 70 can be accessed through the openings 700. A predetermined number of inwardly protruding vertical rib pairs 71 project from each cavity member 70. Each vertical rib pair 71 confines a groove 72 similar to the groove 14 of the seat casing 1 (Refer to FIG. 1).

The base plate 7A has a plurality of screw holes 70A aligned with screw sockets 73 of the plate member 7 to receive screws for fastening the plate member 7 and the base plate 7A together. A printed circuit board 8 is fixed between the plate member 7 and the base plate 7A. A spiral spring resistor 4' is disposed inside each cavity member 70 and comprises a plurality of concentric turns including a topmost turn 41' and a bottom endmost turn 42'. A predetermined number of resistor pieces 3' is provided on the circuit board 8 below each of the spiral spring resistors 4'. Each resistor piece 3' has leg portions attached to the circuit board 8. The bottom endmost turn 42' is electrically isolated from the resistor pieces 3'. The topmost turn 41' of the spiral spring resistor 4' is disposed around a downward projection 93 of one of the push button members 9. A key cap 95 is attached to each push button member 9. Each of the push button members 9 has flange sections projecting into one of the grooves 72 of each cavity member 70 to guide the movement of the push button members 9 relative to the cavity members 70.

When a pressing force is applied to one of the push button members 9, one of the spiral spring resistors 4' is compressed and the contact area between the spiral spring resistor 4' and the resistor pieces 3' is increased, thereby resulting in a reduction in the output resistance. This illustrates the variable resistance feature of the preferred embodiment. By applying a pressing force on the preferred embodiment, the output resistance can be varied in order to produce different voltages.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A variable resistor device, comprising:

a hollow push button seat member having an open top end, a base portion, and a confining wall extending upward from said base portion and defining a receiving space;

at least one resistor piece mounted inside said seat member, each said resistor piece having a contact portion with two ends lying on top of said base portion and at least two leg portions, one of said leg portions projecting outward through said base portion from each end of said contact portion;

a spiral spring resistor disposed inside said receiving space above said resistor piece, said spring resistor having a plurality of concentric turns of varying diameters, said concentric turns including a topmost turn and a bottom endmost turn electrically isolated from said resistor piece; and a push button having a liked body slidably fitted in and guided by said seat member, said slide body having a top portion protruding upward through said open top end of said seat member, and a key cap mounted on said top portion of said slide body, said slide body having a bottom wall connected to said topmost turn, wherein when pressure is applied on said push button, said spring resistor is compressed causing said concentric turns other than said topmost turn and said bottom endmost turn to contact said contact portion of said resistor piece, the number of said concentric turns contacting said resistor piece being varied according to the amount of pressure applied on said push button.

2. The variable resistor device as claimed in claim 1, wherein said variable resistor device comprises two said resistor pieces, said resistor pieces crisscrossing one another at said contact portion, one of said resistor pieces having an upwardly projecting bent portion being spaced from and passing the other one of said resistor pieces.

3. The variable resistor device as claimed in claim 1, including two said resistor pieces, said resistor pieces being spaced apart from each other.

4. The variable resistor device as claimed in claim 1, wherein said turns of said spiral spring resistor are arranged in order of increasing diameter, said topmost turn having the smallest diameter, said bottom endmost turn having the widest diameter.

5. The variable resistor device as claimed in claim 4, wherein said bottom endmost turn is coated in an insulating material and rests on said resistor pieces.

6. The variable resistor device as claimed in claim 4, wherein said base portion has a central area to receive said contact portions of said resistor pieces and a plurality of pairs of raised ribs extending radially from said central area towards said rectangular wall, each said pair of raised ribs receiving a portion of said resistor pieces other than said contact portions and said leg portions, said raised ribs supporting said bottom endmost turn and spacing said bottom endmost turn from said portion of said resistor pieces received by said raised ribs.

7. The variable resistor device as claimed in claim 1, wherein said contact portion of said at least one resistor piece comprises a plate with an opening.

8. The variable resistor device as claimed in claim 7, wherein said turns of said spiral spring resistor include a centermost turn, said topmost turn and said bottom endmost turn having the smallest diameter, said centermost turn having the widest diameter, said bottom endmost turn being disposed in said opening and projecting outward through said base portion, said varying resistance output being taken from said bottom endmost turn of said spiral spring resistor and one of said leg portions of said resistor piece.

9. A keyboard, comprising:

a cover plate having a plurality of openings;

a base plate fastened to said cover plate;

a board fixed between said cover plate and said base plate;

a plurality of confining walls extending upward from said board and each defining a receiving space accessible through said openings;

a plurality of spiral spring resistors each being disposed inside one of said confining walls and having a plurality of concentric turns of varying diameters, said concentric turns including a top endmost turn and a bottom endmost turn;

a plurality of resistor pieces each being disposed on said board below one of said spiral spring resistors, each of said resistor pieces having at least one leg portion attached to said board; and a plurality of push buttons each having a liked body slidably fitted in and guided by one of said confining walls, said slide body having a top portion protruding upward through one of said openings, and a key cap mounted on said top portion of said slide body, said slide body having a bottom wall connected to said top endmost turn of one said spiral spring resistor, whereby whenever one of said push buttons is pressed, one of said spiral spring resistors is urged by said one push button towards a corresponding said resistor piece to increase contact area between said one spiral spring resistor and said resistor piece, thereby resulting in a decrease in resistance to signify a pressed key condition.

10. A variable resistor device, comprising:

a hollow push button seat member confining a receiving space, said seat member having a base portion;

first and second resistor pieces fixed apart from each other inside said seat member, each of said resistor pieces having a contact portion lying on top of said base portion and at least one leg portion projecting outward through said base portion;

a spiral spring resistor disposed inside said receiving space above said resistor pieces, said spring resistor having a plurality of concentric turns of varying diameters, said concentric turns including a topmost turn and a bottom endmost turn electrically isolated from said resistor pieces; and a push button slidably fitted into said seat member, said topmost turn being cooperatively associated with said push button, wherein when said push button is externally pushed, said spring resistor is compressed to cause at least one of said concentric turns other than said topmost turn and said bottom endmost turn to contact both of said resistor pieces, the number of said concentric turns contacting both said resistor pieces being related to the degree of depression of said push button.

* * * * *